US007310078B2

(12) United States Patent
Kim

(10) Patent No.: US 7,310,078 B2
(45) Date of Patent: Dec. 18, 2007

(54) PIXEL AND ORGANIC LIGHT EMITTING DISPLAY USING THE SAME

(75) Inventor: Yang Wan Kim, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 22 days.

(21) Appl. No.: 11/227,970

(22) Filed: Sep. 14, 2005

(65) Prior Publication Data

US 2006/0066253 A1 Mar. 30, 2006

(30) Foreign Application Priority Data

Sep. 24, 2004 (KR) ..... 10-2004-0077006

(51) Int. Cl.
*G09G 3/30* (2006.01)

(52) U.S. Cl. ..... 345/76; 345/82; 315/169.3

(58) Field of Classification Search ..... 345/76, 345/82; 315/169.3
See application file for complete search history.

(56) References Cited

U.S. PATENT DOCUMENTS

2005/0140600 A1* 6/2005 Kim et al. ..... 345/76

FOREIGN PATENT DOCUMENTS

JP 2004-310014 11/2004

OTHER PUBLICATIONS

Patent Abstracts of Japan; Publication No. 2004-310014; Publication Date: Apr. 11, 2004; in the name of Kwon.

* cited by examiner

*Primary Examiner*—David H. Vu
(74) *Attorney, Agent, or Firm*—Christie, Parker & Hale, LLP

(57) ABSTRACT

A pixel including a LED and a pixel circuit. The circuit including a first transistor supplying a current to the LED corresponding to a data signal applied to a data line, a capacitor coupled to the first transistor and charged by the data signal, a second transistor coupled to a scan line and the data line supplying the data signal to the capacitor when a scan signal is being supplied, and a third transistor coupled between the first transistor and the LED and having a gate coupled to a gate of the first transistor. The pixel circuit displays images of uniform luminance by charging the threshold voltage of the first transistor in the capacitor. Further, because voltages of the gate and the second terminal of the first transistor are kept approximately equal, it is possible to display images of desired luminance by eliminating leakage current and kink effect.

5 Claims, 8 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 2004-77006, filed Sep. 24, 2004 the entire content of which is incorporated herein by reference.

FIELD OF THE INVENTION

The present invention relates to a pixel and an organic light emitting display using the same and, more particularly, to a pixel that can display images of uniform luminance and an organic light emitting display using the same.

BACKGROUND OF THE INVENTION

Various kinds of flat panel displays that have lower weight and smaller volume than devices such as cathode ray tubes (CRT) have been developed in recent years. The flat panel displays include liquid crystal displays (LCD), field emission displays (FED), plasma display panels (PDP), organic light emitting displays, and the like. Among these, the organic light emitting display can emit light by recombination of electrons and holes. This display has advantages of fast response speed and low power consumption.

FIG. 1 is a circuit diagram of a pixel 10 of a conventional organic light emitting display. The pixel 10 of the conventional organic light emitting display emits light corresponding to a data signal supplied to a data line D when a scan signal is applied to a scan line S.

As shown in FIG. 2, the scan signals are sequentially applied to the scan lines S starting from a first scan line S1 to an $n^{th}$ scan line Sn. The data signals are applied to the data lines D synchronously with the scan signal. The pixel 10 receives the data signal and displays an image corresponding to the received data signal when the scan signal is applied.

Each pixel 10 includes an organic light emitting diode (LED), and a pixel circuit 12 coupled to the data line D, the scan line S and an anode electrode of the LED.

The anode electrode of the LED is coupled to the pixel circuit 12, and a cathode electrode of the LED is coupled to a second power supply source of voltage VSS. The LED generates light corresponding to an electric current supplied from the pixel circuit 12.

The pixel circuit 12 includes a first transistor M1 coupled to the data line D and the scan line S, a second transistor M2 coupled between a first power supply source of voltage VDD and the LED, and a storage capacitor C coupled between a gate and a source of the second transistor M2.

A gate terminal of the first transistor M1 is coupled to the scan line S, and a source terminal thereof is coupled to the data line D. A drain terminal of the first transistor M1 is coupled to the storage capacitor C. The first transistor M1 is turned on to supply the data signal supplied from the data line D to the storage capacitor C when the scan signal is applied to the scan line S. As a result, a voltage corresponding to the data signal is charged in the storage capacitor C.

A gate terminal of the second transistor M2 is coupled to the storage capacitor C, and a source terminal thereof is coupled to the first power supply source of voltage VDD. A drain terminal of the second transistor M2 is coupled to the anode electrode of the LED. The second transistor M2 controls amount of electric current which flows from the first power supply source of voltage VDD to the LED corresponding to a voltage value stored in the storage capacitor C. The LED generates light of luminance corresponding to amount of the electric current supplied from the second transistor M2.

However, the conventional pixel circuit 12 has a disadvantage in that images of uniform luminance cannot be displayed due to a difference between threshold voltages of the second transistors M2 used in different pixels 10. A plurality of pixels 10 are arranged in an image display portion which displays images. In order for the image display portion to display images of uniform luminance, the threshold voltages of the second transistors M2 in the plurality of pixels 10 should be identical to one another. However, due to processing errors during fabrication, the threshold voltages of the second transistors M2 vary. As a result, the image display portion cannot display images of uniform luminance.

SUMMARY OF THE INVENTION

The present invention, provides a pixel that can display images of uniform luminance and an organic light emitting display using the same.

In an embodiment of the present invention, a pixel includes an organic light emitting diode, a first transistor for providing an electric current corresponding to a voltage signal transmitted to a gate terminal of the first transistor to be supplied to the light emitting diode, a storage capacitor to supply a stored voltage to the gate terminal of the first transistor, a second transistor coupled to a scan line and a data line for enabling the storage capacitor to be charged with voltage corresponding to a data signal applied to the data line when a scan signal is supplied to the $n^{th}$ scan line, where n is a natural number, and a third transistor coupled between the first transistor and the light emitting diode and having a gate terminal coupled to a gate terminal of the first transistor.

The pixel may further include a fourth transistor coupled between the gate terminal and a second terminal of the first transistor and for coupling the first transistor in a diode configuration when the scan signal is supplied, and a fifth transistor coupled between a first power supply source and a first terminal of the first transistor and controlled by a light emitting control signal supplied from a light emitting control line.

In an embodiment of the present invention, a pixel includes first and second power supply sources, an organic light emitting diode having a cathode coupled to the second power supply source, a second transistor having a first terminal coupled to a data line and a gate terminal coupled to a scan line, a first transistor having a first terminal coupled to a second terminal of the second transistor, a third transistor having a gate terminal coupled to a gate terminal of the first transistor, a first terminal coupled to a second terminal of the first transistor, and a second terminal coupled to an anode of the light emitting diode, a fourth transistor having a gate terminal coupled to the scan line, a first terminal coupled to the second terminal of the first transistor, and a second terminal coupled to the gate terminal of the first transistor, and a fifth transistor having a first terminal coupled to the first power supply source, a second terminal coupled to the first terminal of the first transistor, and a gate terminal coupled to a light emitting control line.

In an embodiment of the present invention, an organic light emitting display includes an image display portion having a plurality of pixels coupled to scan lines and data lines, a scan driver for driving the scan lines, and a data driver for driving the data lines, wherein each pixel includes an organic light emitting diode, a first transistor for controlling an electric current supplied to the light emitting diode corresponding to a data signal applied to a data line, a storage capacitor coupled to the first transistor and being charged by a voltage corresponding to the data signal, a second transistor coupled to a scan line and the data line to supply the data signal to the storage capacitor when a scan signal is supplied to an $n^{th}$ scan line (n is a natural number), and a third transistor coupled between the first transistor and the light emitting diode and having a gate terminal coupled to a gate terminal of the first transistor.

DETAILED DESCRIPTION

Figure 1:
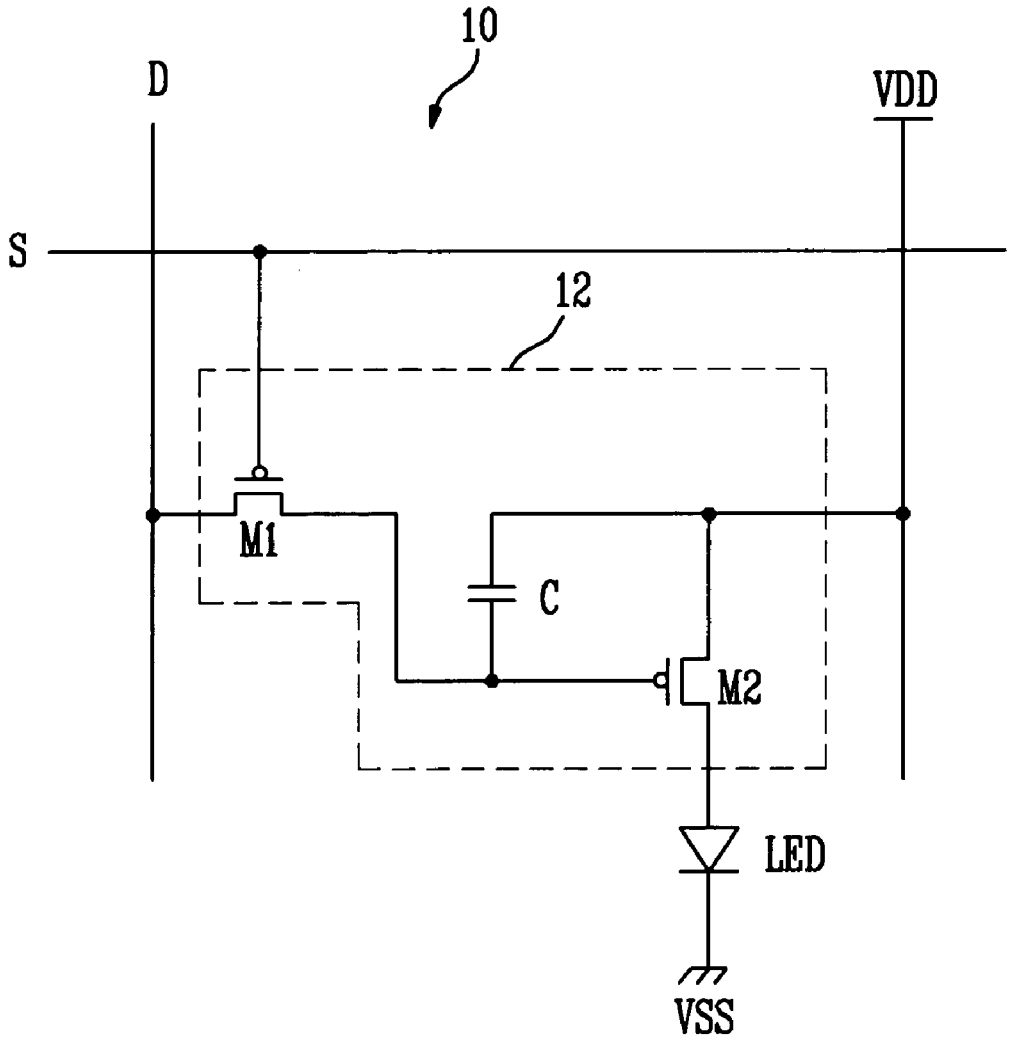
FIG. 1 (PRIOR ART)
FIG. 1 is a circuit diagram of a pixel of a conventional organic light emitting display.
Figure 2:
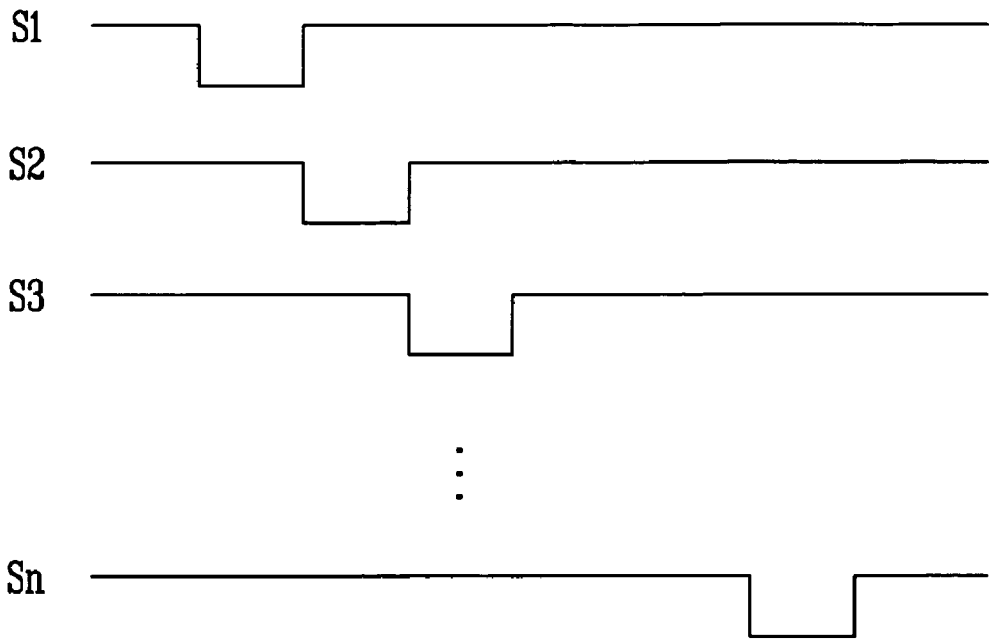
FIG. 2 (PRIOR ART)
FIG. 2 is a wave diagram illustrating scan signals supplied to the scan lines shown in FIG. 1.
Figure 3:
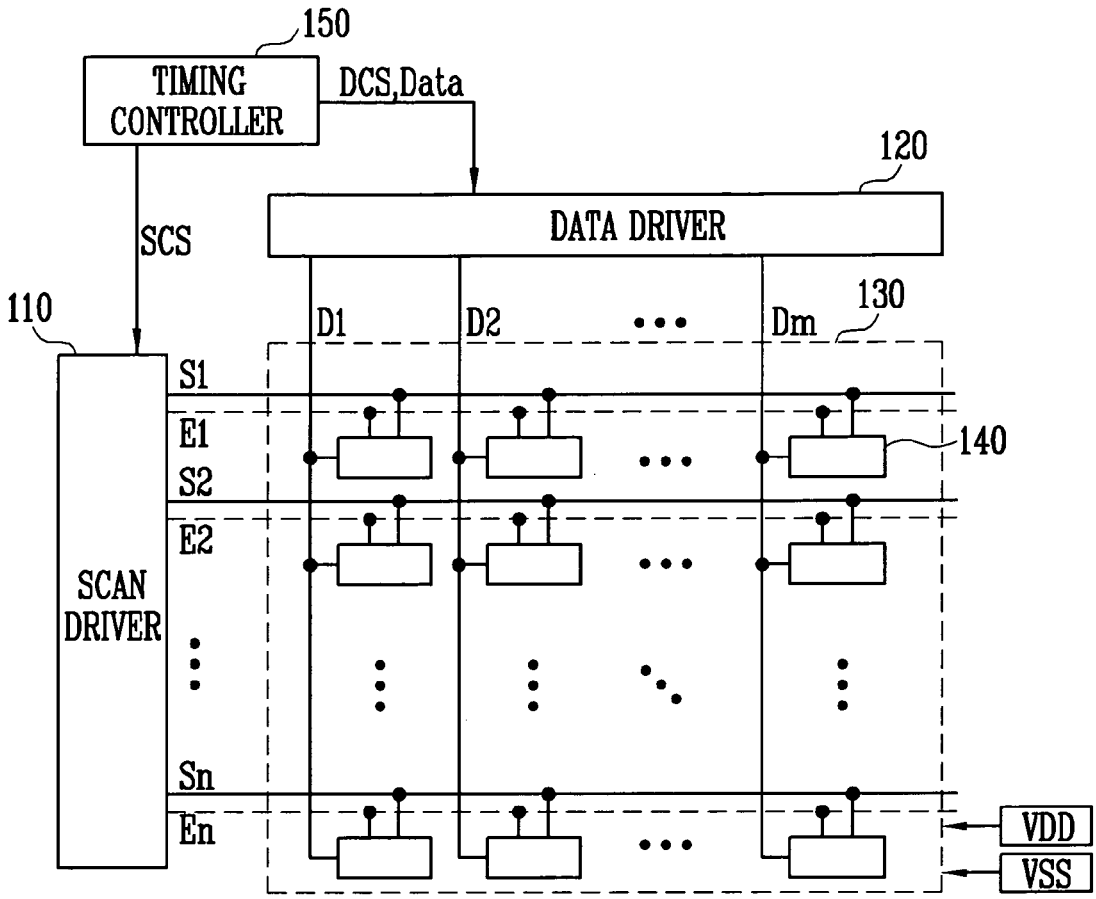
FIG. 3 is a block diagram of an organic light emitting display according to an embodiment of the present invention.

FIG. 3 is a block diagram of an organic light emitting display according to an embodiment of the present invention. The organic light emitting display of the present invention includes an image display portion 130 including pixels 140 which are formed at intersection regions of scan lines S1 to Sn and data lines D1 to Dm, a scan driving portion or scan driver 110 for driving the scan lines S1 to Sn, a data driving portion or data driver 120 for driving the data lines D1 to Dm, and a timing control portion or timing controller 150 for controlling the scan driver 110 and the data driver 120.

The scan driver 110 receives a scan driving control signal SCS from the timing controller 150. The scan driver 110 which has received the scan driving control signal SCS generates scan signals, and sequentially supplies the generated scan signals to the scan lines S1 to Sn. The scan driver 110 generates a light emitting control signal in response to the scan driving control signal SCS, and sequentially supplies the generated light emitting control signals to light emitting control lines E1 to En.

The data driver 120 receives a data driving control signal DCS from the timing controller 150. The data driver 120 which has received the data driving control signal DCS generates data signals, and supplies the generated data signals to the data lines D1 to Dm.

The timing controller 150 generates the data driving control signal DCS and the scan driving control signal SCS in response to synchronous signals supplied from outside the device. The data driving control signal DCS generated in the timing controller 150 is supplied to the data driver 120, and the scan driving control signal SCS is supplied to the scan driver 110. The timing controller 150 also supplies data Data supplied from outside to the data driver 120.

The image display portion 130 receives a first voltage VDD and a second voltage VSS from outside first and second power supply sources. The first voltage VDD and the second voltage VSS are supplied to the pixels 140. Each of the pixels 140 generates light corresponding to the data signal. Emission timing of the pixels 140 is controlled by the light emitting control signals.

Figure 4:
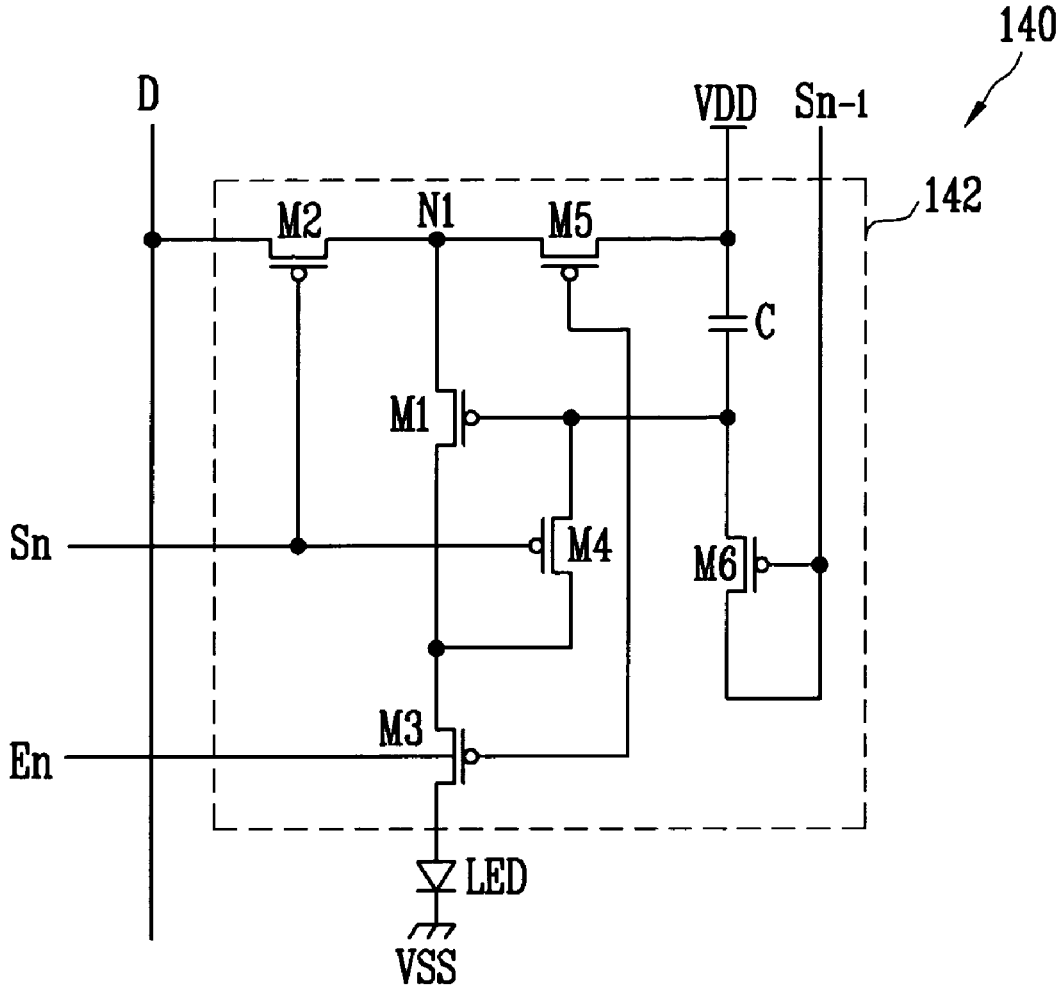
FIG. 4 is a circuit diagram illustrating a first embodiment of the pixel shown in FIG. 3.

FIG. 4 is a circuit diagram illustrating a first embodiment of the pixel 140 shown in FIG. 3. Each pixel 140 according to the first embodiment of the present invention includes an LED, and a pixel circuit 142 coupled to a data line D, a scan line S and a light emitting control line E to allow the LED to emit light.

An anode electrode of the LED is coupled to the pixel circuit 142, and a cathode electrode of the LED is coupled to the second power supply source of voltage VSS. The second voltage VSS is a voltage lower than the first voltage VDD and may be a ground voltage. The LED generates light corresponding to an electric current applied from the pixel circuit 142. In order to generate light, the LED includes an emission layer made of an organic material between the anode electrode and the cathode electrode.

The pixel circuit 142 includes a second transistor M2 and a fifth transistor M5 coupled between the first power supply source of voltage VDD and the data line D, a third transistor M3 coupled to the LED and the light emitting control line En, a first transistor M1 coupled between the third transistor M3 and a first node N1, a sixth transistor M6 coupled between an $(n-1)^{th}$ scan line Sn−1 and a gate terminal of the first transistor M1, and a fourth transistor M4 coupled between a gate terminal and a second terminal of the first transistor M1. The second terminal of any of the mentioned transistors may be either a source terminal or a drain terminal depending on the type of the transistor used and the term first terminal is used to indicate a terminal different from the second terminal. For example, when the second terminal is the source terminal, the first terminal is set as the drain terminal, and when the second terminal is the drain terminal, the first terminal is set as the source terminal.

A first terminal of the first transistor M1 is coupled to the first node N1. The second terminal of the first transistor M1 is coupled to a first terminal of the third transistor M3, and the gate terminal of the first transistor M1 is coupled to a storage capacitor C. The first transistor M1 supplies an electric current corresponding to a voltage charged in the storage capacitor C to the LED.

A gate terminal and a first terminal of the sixth transistor M6 are coupled to the $(n-1)^{th}$ scan line Sn−1, and a second terminal of the sixth transistor M6 is coupled to the gate terminal of the first transistor M1. The sixth transistor M6 is turned on when a scan signal is supplied to the $(n-1)^{th}$ scan line Sn−1. When the sixth transistor M6 is turned on, the scan signal supplied to the $(n-1)^{th}$ scan line Sn−1 is supplied to the gate terminal of the first transistor M1 and the storage capacitor C, and thus the gate terminal of the first transistor M1 and the storage capacitor C are initialized.

A second terminal of the fourth transistor M4 is coupled to the gate terminal of the first transistor M1, and a first terminal of the fourth transistor M4 is coupled to the second terminal of the first transistor M1. A gate terminal of the fourth transistor M4 is coupled to an $n^{th}$ scan line Sn. When a scan signal is supplied to the $n_{th}$ scan line Sn, the fourth transistor M4 is turned on and connects the gate and the second terminal of the first transistor M1 in a diode configuration.

A first terminal of the second transistor M2 is coupled to the data line D, and a second terminal of the second transistor M2 is coupled to the first node N1. A gate terminal of the second transistor M2 is coupled to the $n^{th}$ scan line Sn. When a scan signal is applied to the $n^{th}$ scan line Sn, the second transistor M2 is turned on and supplies a data signal supplied to the data line D to the first node N1.

A second terminal of the fifth transistor M5 is coupled to the first node N1, and a first terminal of the fifth transistor M5 is coupled to the first power supply source of voltage VDD. A gate terminal of the fifth transistor M5 is coupled to the light emitting control line En. When the light emitting control signal is not being supplied to the light emitting control line En, the fifth transistor M5 is turned on and electrically couples the first power supply source of voltage VDD to the first node N1.

A first terminal of the third transistor M3 is coupled to the second terminal of the first transistor M1, and a second terminal of the third transistor M3 is coupled to the LED. A gate terminal of the third transistor M3 is coupled to the light emitting control signal En. When the light emitting control signal is not being supplied, the third transistor M3 is turned on and supplies an electric current supplied from the first transistor M1 to the LED.

Figure 5:
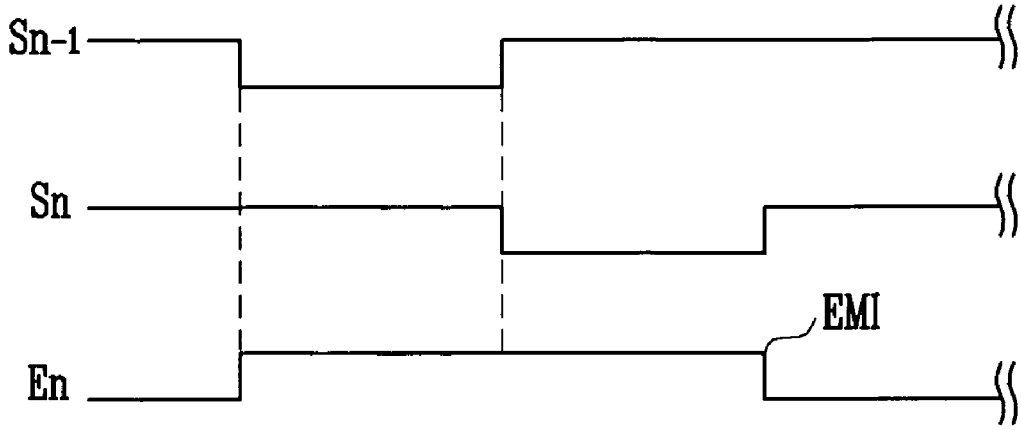
FIG. 5 is a diagram illustrating driving waves supplied from the scan driver shown in FIG. 3.

FIG. 5 is a diagram illustrating driving waves supplied from the scan driver 110 shown in FIG. 3. Operation of one pixel 140 is explained below with reference to FIGS. 4 and 5. First, when a scan signal is supplied to the $(n-1)^{th}$ scan line Sn−1, the sixth transistor M6 is turned on. When the sixth transistor M6 is turned on, the scan signal is supplied to the gate terminal of the first transistor M1 for initialization. The scan signal has a voltage value lower than the data signal. Thus, the first transistor M1, which is shown as a PMOS transistor in the exemplary drawing, can be turned on regardless of a voltage value of the data signal applied to the first node N1.

Thereafter, the scan signal is supplied to the $n^{th}$ scan line Sn. When the scan signal is supplied to the $n^{th}$ scan line Sn, the second transistor M2 and the fourth transistor M4 are turned on. When the second transistor M2 is turned on, the data signal is supplied to the first node N1. When the fourth transistor M4 is turned on, the first transistor M1 is coupled in a diode configuration. Thus, the data signal supplied to the first node N1 is supplied to the gate terminal of the first transistor M1 and one plate of the storage capacitor C through the first and fourth transistors M1, M4. At this time, a voltage corresponding to the data signal is charged in the storage capacitor C. Also, a voltage corresponding to the threshold voltage of the first transistor M1 is additionally charged in the storage capacitor C.

When the voltage corresponding to the threshold voltage of the first transistor M1 is additionally charged in the storage capacitor C, an image of uniform luminance can be displayed regardless of the variation in the threshold voltages of the various first transistors M1. That is, when the voltage corresponding to the threshold voltage of the first transistor M1 is additionally charged in the storage capacitor C contained in each of the pixels 140, uniform images can be displayed regardless of the threshold voltages of each of the first transistors M1.

Thereafter, supply of the light emitting control signal EMI supplied to the $n^{th}$ light emitting control line En is stopped, so that the third and fifth transistors M3 and M5 are turned on. When the third and fifth transistors M3 and M5 are turned on, an electric current corresponding to the voltage charged in the storage capacitor C, and starting from the first power supply source of voltage VDD, passes through the fifth transistor M5, the first transistor M1, and the third transistor M3 and is supplied to the LED. This current enables the LED to generate light corresponding to the data signal.

However, due to kink effect and leakage current, an image of desired luminance cannot be obtained by using the pixel 140. This is a disadvantage of the pixel 140 of the first embodiment.

In more detail, at a point in time when the data signal is applied to the storage capacitor C, i.e., when the second transistor M2, the first transistor M1 and the fourth transistor M4 are turned on, the gate terminal and the second terminal of the first transistor M1 are at the same voltage (VGD=0). However, when the light emitting control signal EMI and the scan signal supplied to the $n^{th}$ scan line Sn are stopped, the third transistor turns on, the fourth transistor M4 turns off and a voltage difference arises between the gate terminal and the second terminal of the first transistor M1.

When the supply of the light emitting control signal EMI is stopped, a low voltage, e.g., a voltage of 0 volt is applied to the gate terminal of the third transistor M3. In the exemplary embodiment shown, when the voltage of 0 volt is applied to the gate terminal of the third transistor M3, the second terminal of the first transistor M1 is also set to about 0 volt. The gate terminal of the first transistor M1 maintains a voltage corresponding to the storage capacitor C. As described above, a voltage difference arises between the gate terminal and the second terminal of the first transistor M1, so that an undesirable electric current is supplied to the LED (Kink Effect). Because the voltage of the gate terminal of the first transistor M1 is set to be higher than the voltage of the second terminal, a predetermined leakage current is additionally supplied to the LED through the fourth transistor M4. That is, the pixel 140 of FIG. 4 has the disadvantage of supplying a leakage current to the LED in addition to the electric current corresponding to the data signal and cannot display images of desired luminance. In order to solve this problem, the pixel 144 of FIG. 6 is suggested in another embodiment of the present invention.

Figure 6:
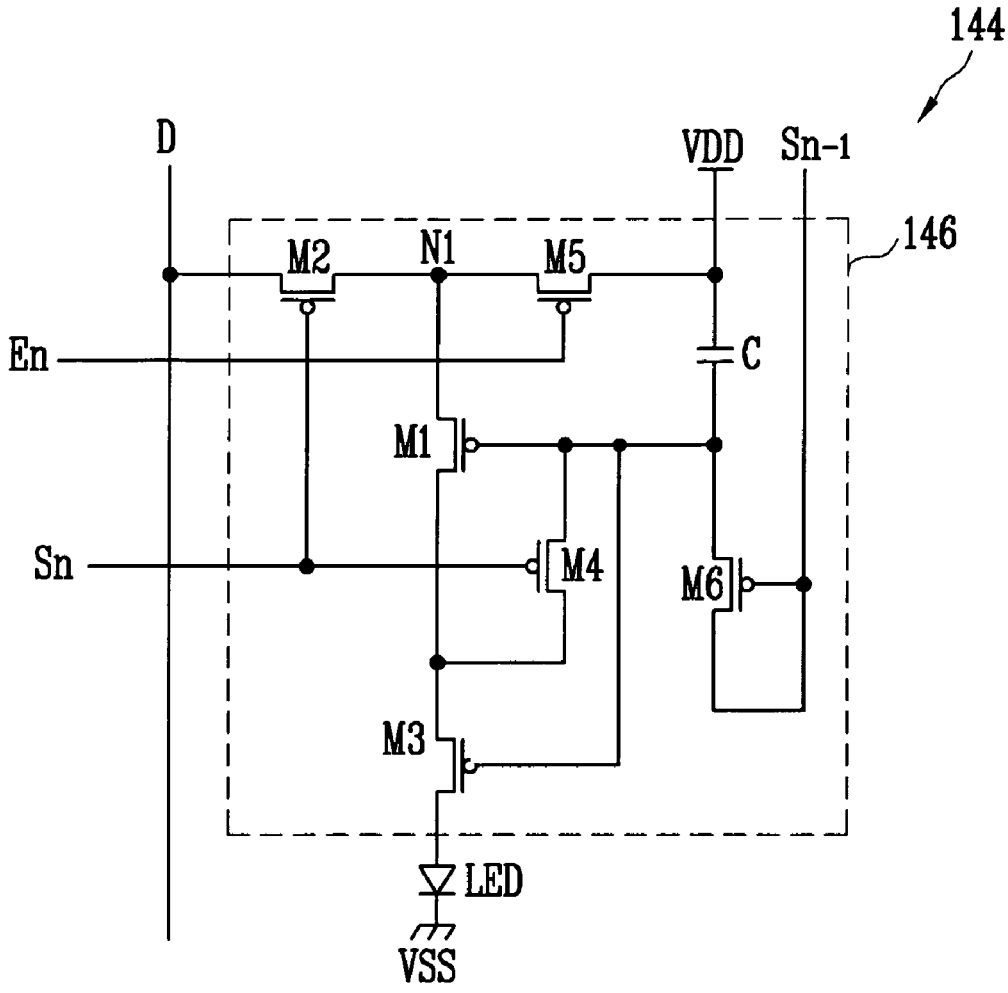
FIG. 6 is a circuit diagram illustrating a second embodiment of the pixel shown in FIG. 3.

FIG. 6 is a circuit diagram illustrating a second embodiment 144 of the pixel 140 shown in FIG. 3. The pixel 144 of FIG. 6 is explained below omitting descriptions of similar elements and arrangements.

Referring to FIG. 6, the gate terminal of the third transistor M3 is coupled to the gate terminal of the first transistor M1. When the gate terminal of the third transistor M3 is coupled to the gate terminal of the first transistor M1, the gate terminal and the second terminal of the first transistor M1 are maintained at approximately the same voltage.

In more detail, at a point in time when the data signal is applied to the storage capacitor C, i.e., when the second transistor M2, the first transistor M1 and the fourth transistor M4 are turned on, the gate terminal and the second terminal of the first transistor M1 maintain the same voltage (VGD=0).

When the scan signal supplied to the $n^{th}$ scan line Sn ends, a voltage charged in the storage capacitor C is supplied to the gate terminal of the first transistor M1 and the gate terminal of the third transistor M3. When the same voltage is supplied to the gate terminal of the first transistor M1 and the gate terminal of the third transistor M3, the voltages of the gate terminal and the second terminal of the first transistor M1 are maintained at approximately the same level. Thus, even after the supply of the scan signal has stopped and the fourth transistor M4 turns off, non-desired electric current is not supplied to the LED.

Figure 7:
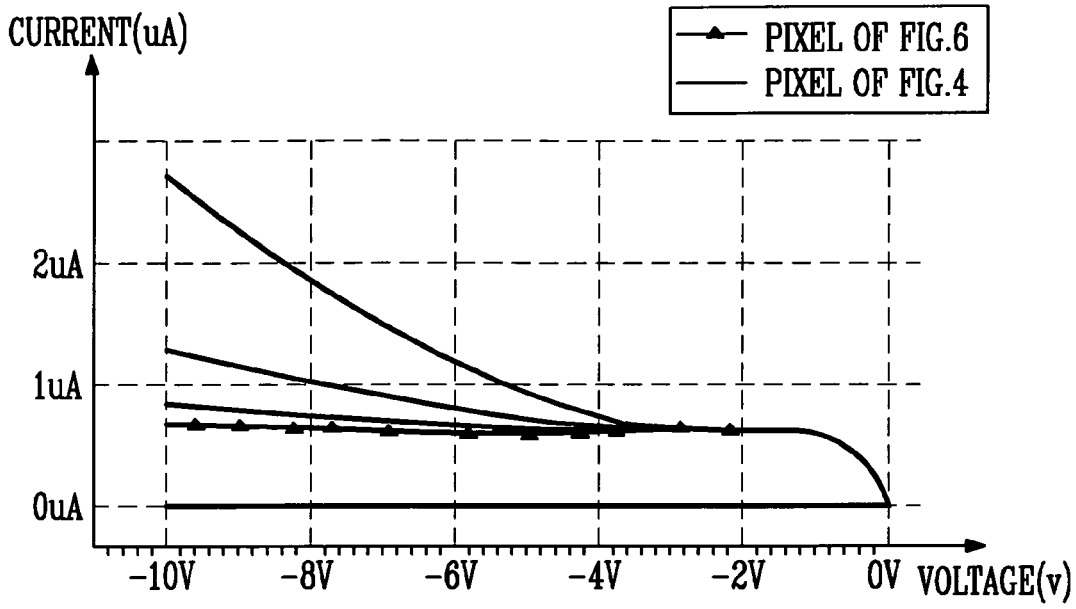
FIGS. 7 and 8 are graphs illustrating electric currents supplied to an LED of the pixel of FIG. 4 and FIG. 6, respectively.

In the first transistor M1 of the pixel 144 of FIG. 6, even though a voltage difference occurs between the second terminal and the first terminal, an electric current, shown in FIG. 7, flows that has a small variation of about 0.02 nA over a voltage difference range of 0V to 10V. However, voltage difference between the second terminal and the first terminal of the first transistor M1 causes a large current fluctuation in the pixel 140 of FIG. 4. The current variation of pixel 140, as shown in FIG. 7, is about 92 nA over voltage difference range of 0V to 10V.

Figure 8:
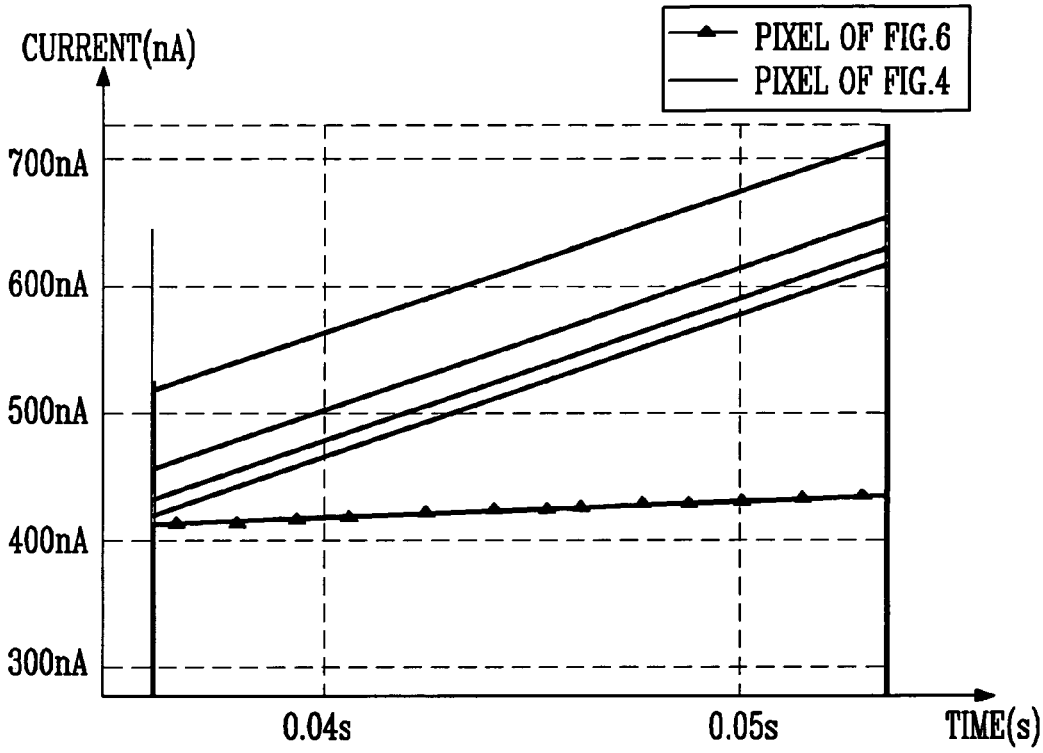

Also, in the present invention, because voltages of the gate terminal and the second terminal of the first transistor M1 are maintained at approximately the same level, that is, the first terminal and the second terminal of the fourth transistor M4 have approximately the same voltage, a leakage current seldom occurs as shown in FIG. 8 (leakage current is about 17 nA). However the gate terminal and the second terminal of the pixel of FIG. 4 have different voltage values, and thus a large leakage current flows through the fourth transistor M4 (leakage current is about 192 nA).

That is, the pixel of FIG. 6 maintains voltages of the gate terminal and the second terminal of the first transistor M1 to be approximately equal in order to display images of desired luminance.

Further, in the present invention, as shown in FIG. 6, a voltage charged in the storage capacitor C is supplied to the gate terminals of the first transistor M1 and the third transistor M3. Therefore, the present invention can control the amount of electric current flowing to the LED by controlling the channel width to length ratio (W/L) of the first transistor M1 and the third transistor M3. The channel W/L of the first transistor M1 may be set to be identical to or different from the channel W/L of the third transistor M3.

FIG. 6 shows p-type MOSFETs used in the circuit 146 of pixel 144. Alternatively, the circuit may be implemented using n-type MOSFETs. If the circuit is implemented using n-type MOSFETs, operating processes remain the same while polarity of a driving wave is inverted.

As described above, the pixel 140, 144 and the organic light emitting display using this pixel of the present invention can display images of uniform luminance by charging a voltage corresponding to the threshold voltage of the first transistor M1 in the storage capacitor C of the pixel circuit 142, 146, 150. Further, because voltages of the gate terminal and the second terminal of the first transistor M1 are maintained at approximately the same level, it is possible to prevent leakage current and current resulting from kink effect from being supplied to the LED, in order to display images of desired luminance.

Although the present invention has been described with reference to certain exemplary embodiments, it will be understood by those skilled in the art that a variety of modifications and variations may be made to the present invention without departing from the spirit or scope of the present invention defined in the appended claims, and their equivalents.

What is claimed is:

1. A pixel comprising:

an organic light emitting diode;

a first transistor for supplying an electric current to the organic light emitting diode, the electric current corresponding to a voltage signal transmitted to a gate terminal of the first transistor;

a storage capacitor for supplying a stored voltage to the gate terminal of the first transistor;

a second transistor coupled to a scan line and a data line and for charging the storage capacitor with a voltage corresponding to a data signal applied to the data line when a scan signal is supplied to the scan line;

a third transistor coupled between the first transistor and the organic light emitting diode and having a gate terminal coupled to a gate terminal of the first transistor;

a fourth transistor coupled between the gate terminal and a second terminal of the first transistor to couple the first transistor in a diode configuration when the scan signal is being supplied to a gate terminal of the fourth transistor; and a fifth transistor coupled between a first power supply and a first terminal of the first transistor and controlled by a light emitting control signal supplied from a light emitting control line.

2. The pixel of claim 1, further comprising a sixth transistor coupled between a previous scan line and the gate terminal of the first transistor.

3. The pixel of claim 2, wherein the first transistor, the second transistor, the third transistor, the fourth transistor, the fifth transistor, and the sixth transistor are PMOS transistors.

4. The pixel of claim 1, wherein an amount of the electric current supplied to the organic light emitting diode is controlled by controlling channel width to length ratios of the first transistor and the third transistor.

5. An organic light emitting display comprising:

an image display portion having a plurality of pixels, each pixel coupled to a respective scan line and a respective data line;

a scan driver for driving the scan lines; and a data driver for driving the data lines, wherein each of the plurality of pixels includes:

an organic light emitting diode;

a first transistor for supplying an electric current to the organic light emitting diode corresponding to a data signal applied to the respective data line coupled to the pixel;

a storage capacitor coupled to the first transistor and being charged by a voltage corresponding to the data signal;

a second transistor coupled to the respective scan line and to the respective data line for supplying the data signal to the storage capacitor when a scan signal is supplied to the respective scan line;

a third transistor coupled between the first transistor and the organic light emitting diode and having a gate terminal coupled to a gate terminal of the first transistor;

a fourth transistor for coupling the second transistor in a diode configuration when the scan signal is being supplied to the respective scan line; and at least one fifth transistor for enabling the supplying of the electric current to the organic light emitting diode corresponding to a light emitting control signal supplied from a light emitting control line coupled to the pixel.

* * * * *